US006112977A

United States Patent [19]

Sutherland et al.

[11] Patent Number: 6,112,977

[45] Date of Patent: Sep. 5, 2000

[54] BOTTLE CARRIER WITH DIVIDERS

[75] Inventors: Robert L. Sutherland, Kennesaw; Glen Ray Harrelson, Gainesville, both of Ga.

[73] Assignee: Riverwood International Corporation, Atlanta, Ga.

[21] Appl. No.: 09/243,990

[22] Filed: Feb. 3, 1999

[51] Int. Cl.[7] ..... B65D 5/4805; B65D 5/49

[52] U.S. Cl. ..... 229/117.13; 206/427; 229/120.18; 229/120.24; 229/120.26

[58] Field of Search ..... 229/117.13, 120.08, 229/120.18, 120.24, 120.26, 120.28; 206/141, 427

[56] References Cited

U.S. PATENT DOCUMENTS

| | | | |
|---|---|---|---|
| 2,779,499 | 1/1957 | Chidsey, Jr. | 206/141 |
| 2,832,504 | 4/1958 | Foster | 206/141 |
| 3,157,309 | 11/1964 | Chidsey, Jr. et al. | 229/120.08 |
| 3,677,458 | 7/1972 | Gosling | 229/120.08 |
| 3,974,911 | 8/1976 | Graser | 229/120.08 |
| 4,103,770 | 8/1978 | Brandenburger et al. | 229/120.08 |
| 4,327,829 | 5/1982 | Hughes | 229/117.13 |
| 4,830,267 | 5/1989 | Wilson | 206/427 |
| 5,020,668 | 6/1991 | Schuster | 206/427 |
| 5,873,516 | 2/1999 | Boggs | 229/117.13 |

FOREIGN PATENT DOCUMENTS

| | | | |
|---|---|---|---|
| 77082 | 4/1983 | European Pat. Off. | 206/141 |

*Primary Examiner*—Gary E. Elkins

[57] ABSTRACT

This invention relates to a carrier, said carrier comprising a top panel section, a first side panel section and an opposing second side panel section, a bottom panel section, and a divider section. The side panel sections are connected to opposing side edges of the top panel section and to opposing side edges of the bottom panel section. The divider panel section is connected to the top panel section and to the bottom panel section. The divider panel section has at least one divider panel that extends between the top panel section and the bottom panel section to form article lanes. The divider section preferably includes a handle reinforcement portion, a first divider panel, and a second divider panel. The handle reinforcement portion is attached to a handle grip portion in the top panel. Top edges of the divider panels are foldably connected to opposing side edges of said handle reinforcement portion. The divider panels have a glue flap attached to the bottom panel section.

14 Claims, 10 Drawing Sheets

BOTTLE CARRIER WITH DIVIDERS

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to article carriers. More particularly, the invention relates to a carrier having partitions or dividers between rows of articles. The invention has particular utility as a carrier for breakable articles such as glass bottles.

2. Background Information

A typical article portion has a top panel, a bottom panel, opposing side panels, and opposing end panels that enclose an article configuration. Known article carriers are believed to have significant limitations and shortcomings. The articles are jostled within the carrier and contact each other during transportation. Articles may suffer structural fatigue if they strike each other repeatedly, which may result in breaking, chipping, or otherwise damaging the articles, particularly glass bottles, during transportation. Furthermore, the mass and motion of the other articles within the carrier may cause the articles to strike each other with larger forces and increase the potential of breaking. Additionally, carrying heavy breakable articles such as glass bottles in these carriers may unevenly distribute lifting forces, may increase the jostling of the articles in the carrier, and may cause the handle to tear.

Applicant's invention provides an article carrier which is believed to constitute an improvement over the known art.

BRIEF SUMMARY OF THE INVENTION

The present invention provides a bottle carrier which generally comprises opposing side panel sections connected to a top panel section and a bottom panel section. The bottle carrier further comprises a divider section connected to the top panel section. The divider panel section has at least one divider panel that extends between the top panel section and the bottom panel section to form article lanes that separate rows of articles. The divider section preferably includes a handle reinforcement portion, a first divider panel, and a second divider panel for forming three article lanes. The handle reinforcement portion is attached to a handle grip portion in the top panel to form a double ply handle for the carrier. The divider panels are foldably connected to the handle reinforcement portion and also have a glue flap attached to the bottom panel section.

The divider panels limit the movement of the articles within the carrier when the carrier is transported. The divider panels limit the motion of each row of bottles, and thus prevent the articles from striking each other with larger forces because of the mass and motion of the articles in other rows within the carrier. The divider panels function as a cushion between the rows of breakable articles. The handle reinforcement portion of the divider section reinforces or strengthens the handle of the carrier. The divider section distributes the forces associated with lifting the carrier by the handle because the divider section is attached to both the top and bottom panel sections.

The features, benefits and objects of this invention will become clear to those skilled in the art by reference to the following description, claims and drawings.

DETAILED DESCRIPTION

Figure 6:
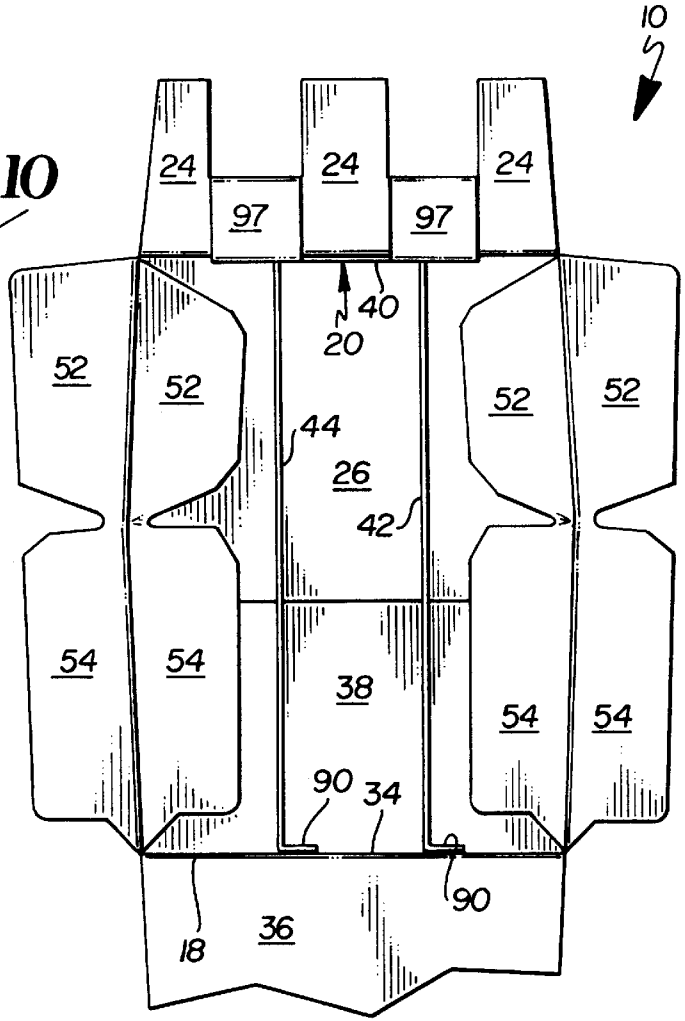
FIG. 6 is a end view through an open end of the carrier of FIG. 1.
Figure 1:
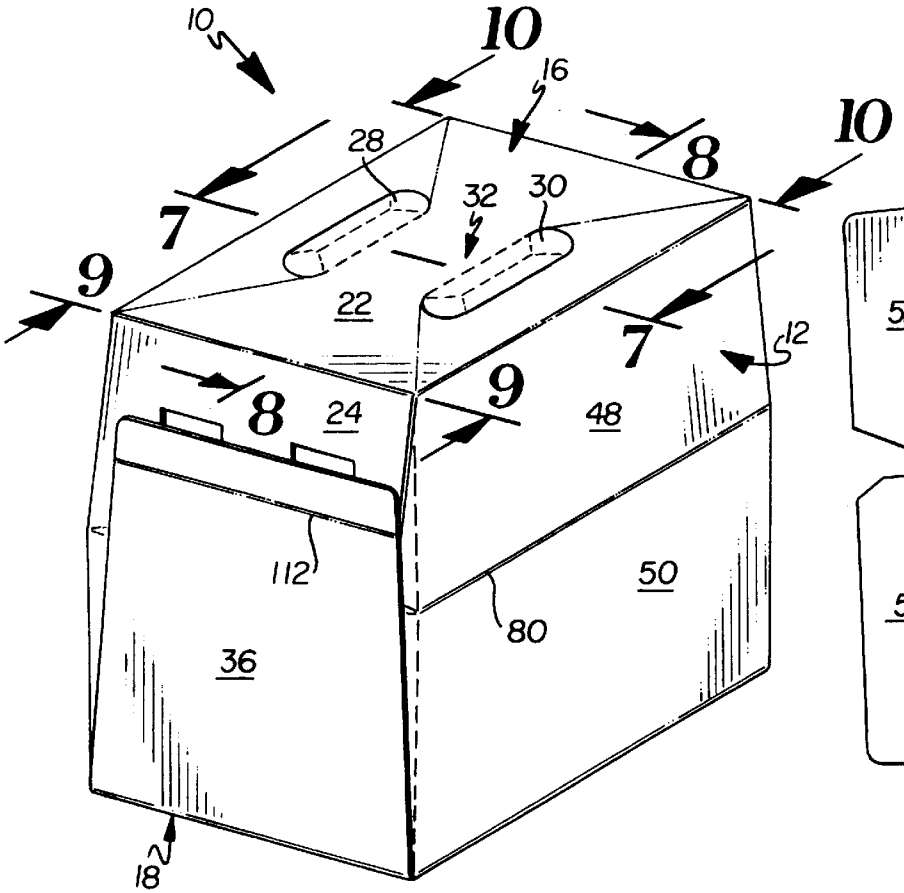
FIG. 1 is a perspective view of an embodiment of the carrier of the present invention.

Referring to FIGS. 1 and 6, the carrier 10 is generally comprised of side panel sections 12 and 14 connected to a top panel section 16 and a bottom panel section 18, and is further comprised of a divider section 20 positioned within the formed carrier 10. The top panel section 16 includes a top panel 22 and two upper end panels 24 and 26. The top panel 22 has two handle grip tabs 28 and 30 and a handle grip portion 32 positioned between the tabs 28 and 30. The tabs 28 and 30 fold inward along the edges of the handle grip portion 32 to create finger openings. The bottom panel section 18 includes a bottom panel 34 and two lower end panels 36 and 38. The upper end panels 24 and 26 and the lower end panels 36 and 38 form end panel sections for the carrier 10. The divider section 20 includes a handle reinforcement portion 40 and two divider panels 42 and 44. The handle reinforcement portion 40 is glued or otherwise attached beneath the handle grip portion 32 of the top panel 22 to form a two-ply handle. The divider panels 42 and 44 extend from the top panel 22 and are glued or otherwise attached to the bottom panel 34 to form article lanes. Each of the side panel sections 12 and 14 include a beveled upper portion 48, a lower portion 50, upper flaps 52 and lower flaps 54.

Figure 2:
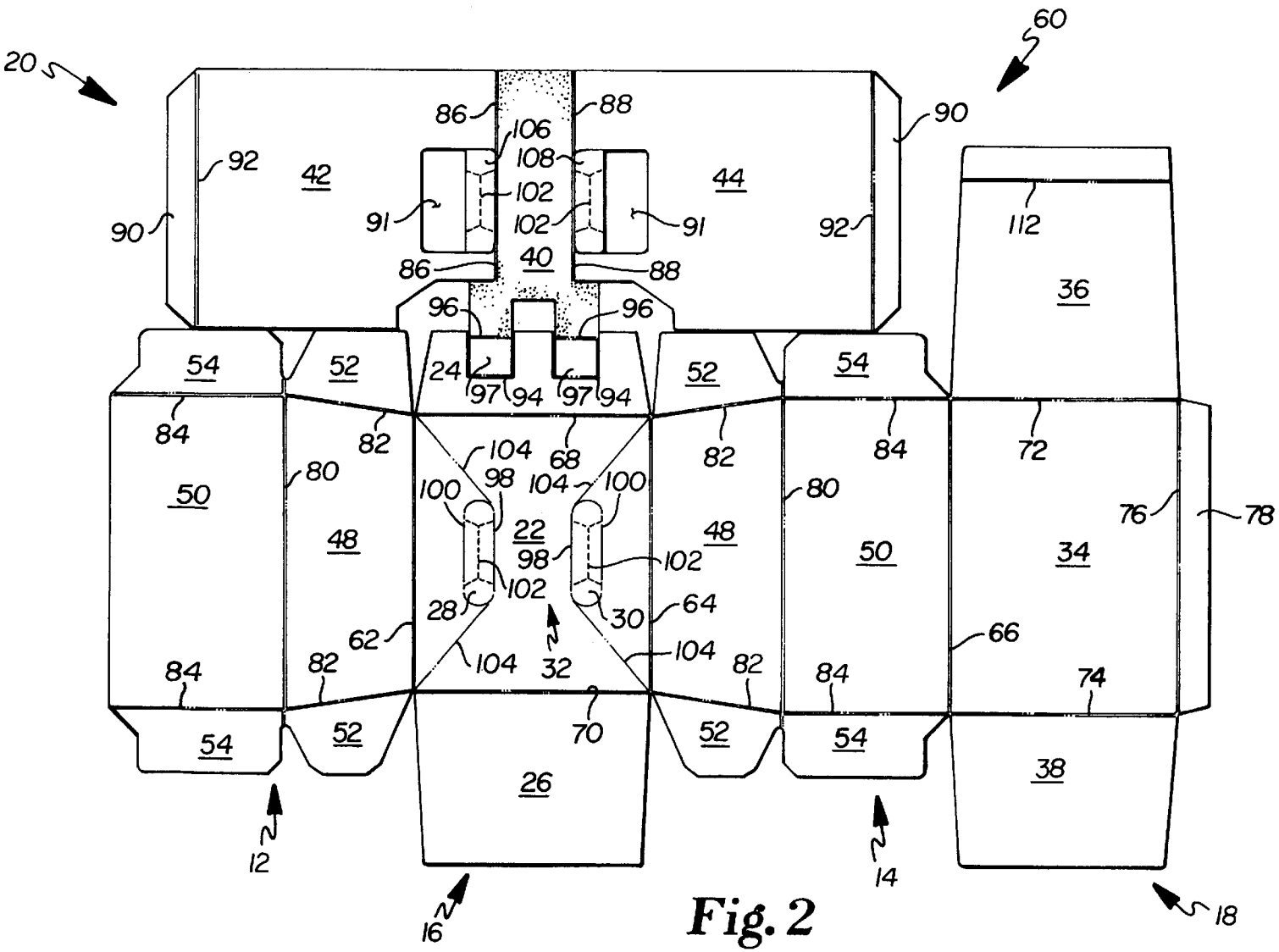
FIG. 2 is a plan view of a blank for forming the carrier of FIG. 1.

Referring to FIG. 2, a generally rectangular blank 60 from which the carrier 10 is formed is comprised of the top panel section 16 connected by opposite fold lines 62 and 64 to the side panel sections 12 and 14. The bottom panel section 18 is connected by fold line 66 to the side panel section 14. The top panel section 16 includes the top panel 22 connected by fold line 68 to the upper end panel 24 and by fold line 70 to upper end panel 26. The bottom panel section 18 includes the bottom panel 34 connected by fold line 72 to the lower end panel 36, by fold line 74 to the lower end panel 38, and by fold line 76 to a glue flap 78. A fold line 80 connects the upper portion 48 to the lower portion 50 of the side panel sections 12 and 14. The upper portion 48 is connected by fold lines 82 to the upper flaps 52, and the lower portion 50 by fold lines 84 to the lower flaps 54. The divider section 20 includes the handle reinforcement portion 40 connected by fold lines 86 to the divider panel 42 and by fold lines 88 to the divider panel 44. Each of the divider panels 42 and 44 has finger openings 91 through which a person's fingers may extend when the carrier is lifted by the handle. A glue flap 90 is connected by fold line 92 to the bottom of each of the divider panels 42 and 44. The handle reinforcement handle 40 is connected by fold lines 94 to the upper end panel 24 of the top panel section 16. The handle reinforcement portion 40 further includes fold lines 96 spaced the same distance from fold lines 94 as fold line 68 is spaced from fold lines 94. The fold lines 94 and 96 define hinge flaps 97 that fold adjacent to the upper end panel 24 when the handle reinforcement portion 40 is adhered to the top panel 22.

The top panel 22 has two handle grip tabs 28 and 30 and a handle grip portion 32 positioned between the tabs 28 and 30. The tabs 28 and 30 are generally oval-shaped and are formed by a fold line 98 and a cut 100. The tabs 28 and 30 have stress relieving score lines 102 configured to allow tabs to be pressed between two adjacent article tops in a formed carrier. The score lines 102 preferably are configured to include a line parallel to the fold line 98 and two arcuate lines on each end of the tabs 28 and 30. The top panel 22 preferably has stress relieving score lines 104 extending from the fold lines 98 to each corner of the top panel 22 as shown in FIG. 2. Reinforcement tabs 106 and 108 are connected by fold lines 110 to the handle reinforcement handle 40. The reinforcement tabs 106 and 108 also have stress relieving score lines 102 similar to the tabs 28 and 30. The reinforcement tabs 106 and 108 correspond to the handle grip tabs 28 and 30 in an assembled carrier 10.

The blank 60 forms a carrier 10 for bottles which has a narrower top portion that conforms to the shape of the bottle necks, thus allowing the carrier 10 to firmly encase the bottles. The side panel sections 12 and 14 have generally vertical lower portions 50 and upper portions 48 that are beveled inward toward each other to correspond to the shape of the bottle necks. The upper flaps 52 and lower flaps 54 are separated by a v-shaped notch, wherein the lower flaps 54 are connected to the lower portion 50 by generally orthogonal fold lines 84 and the upper flaps 52 are connected to the upper portion 48 by generally converging fold lines 82. The v-shaped notch allows the upper flaps 52 to fold slightly downward about the fold lines 82 toward the lower flaps 54 to form the narrower top of the carrier 10.

Figure 3:
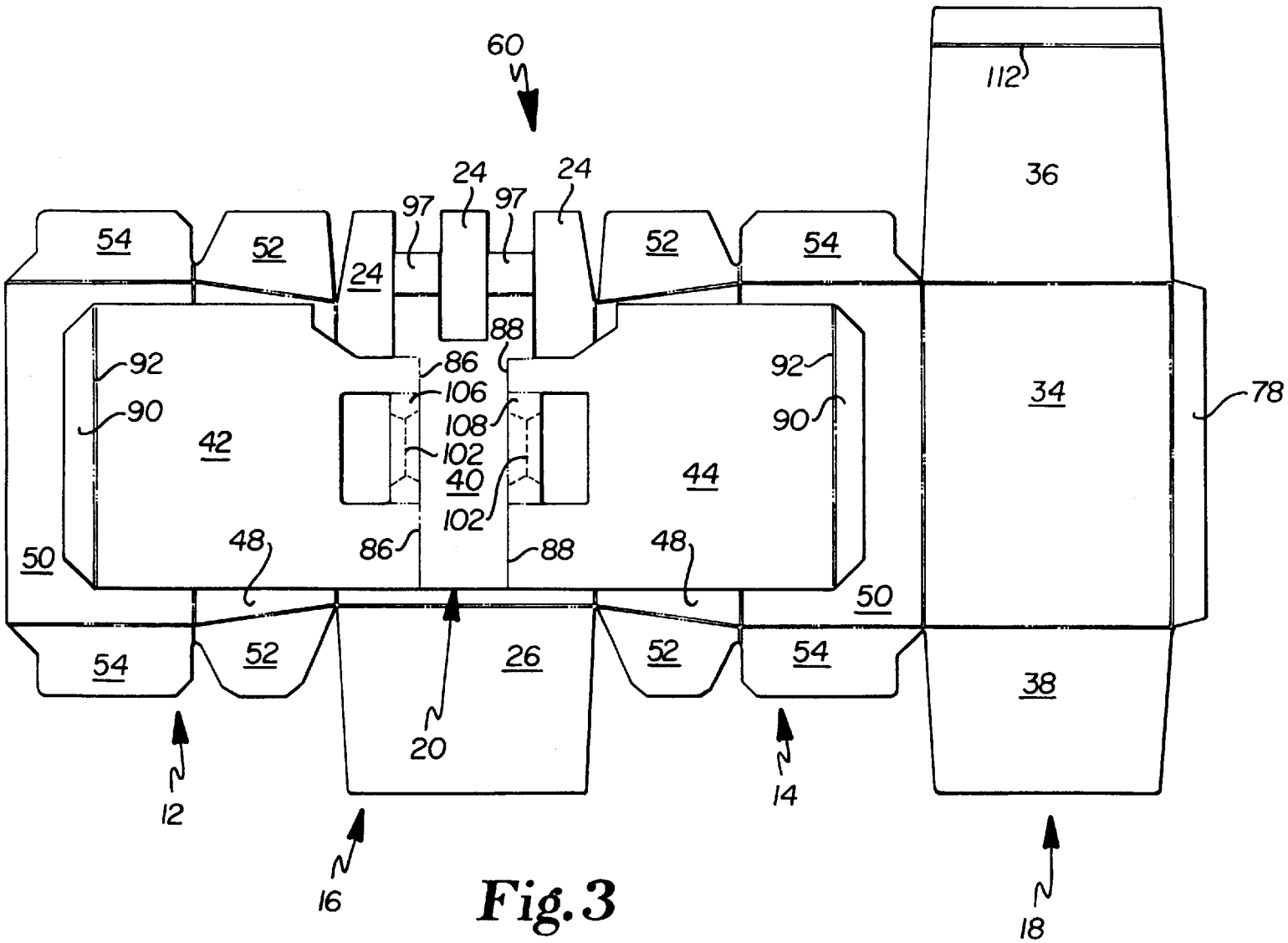
FIG. 3 is a plan view of the blank of FIG. 2 after an initial folding and gluing step.
Figure 5:
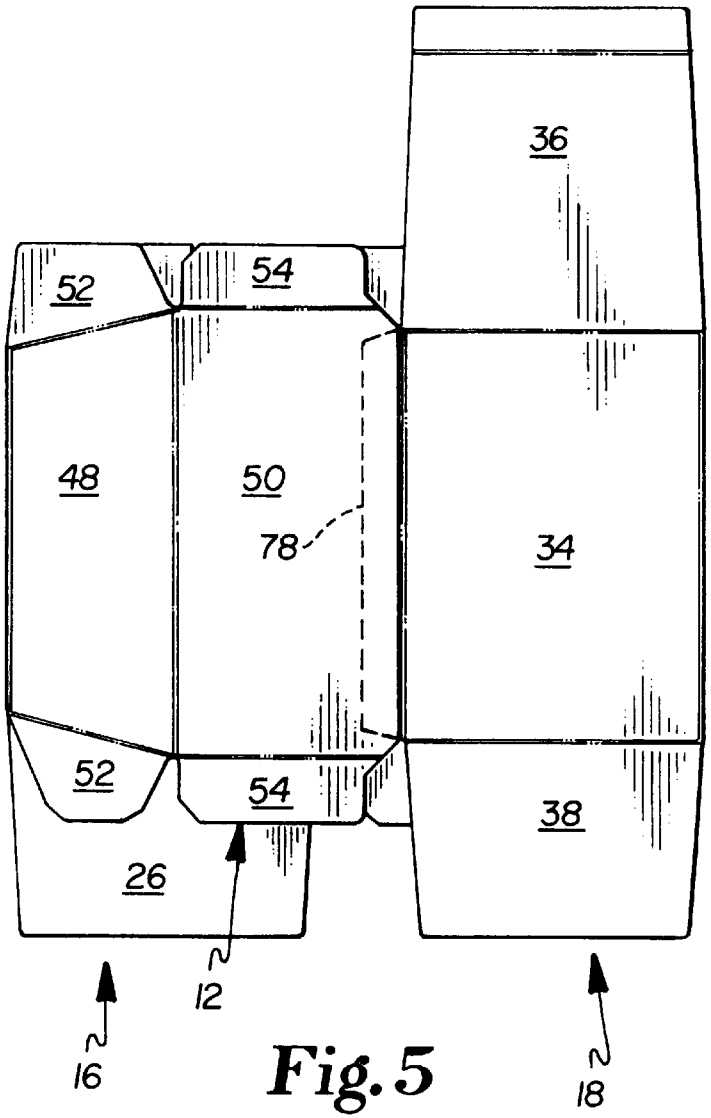
FIG. 5 is a partial plan view of the blank of FIG. 2 after a third folding and gluing step.
Figure 4:
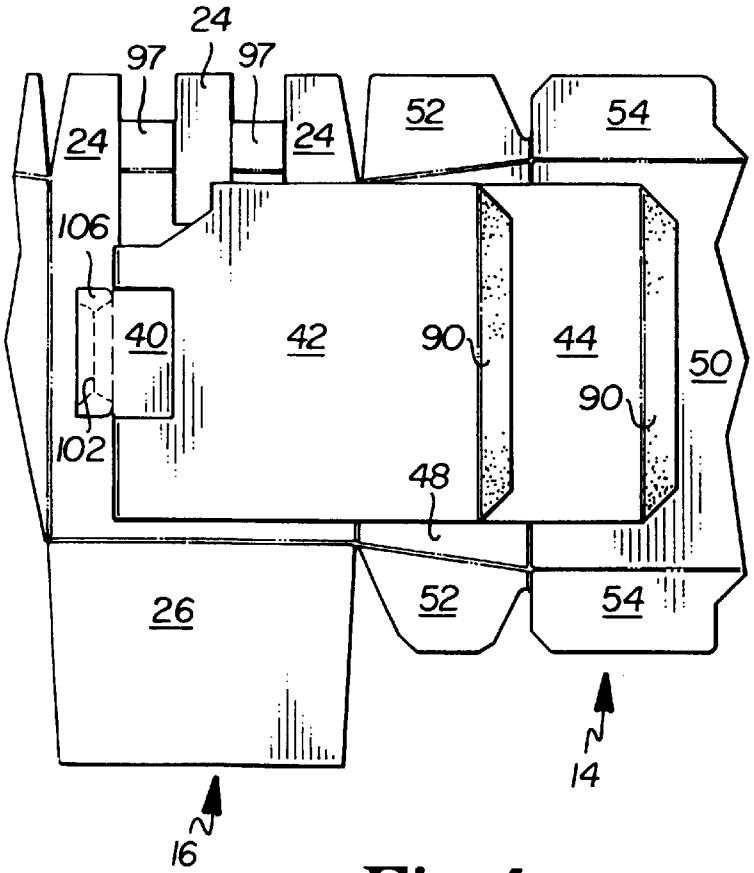
FIG. 4 is a partial plan view of the blank of FIG. 2 after a second folding step.
Figure 9:
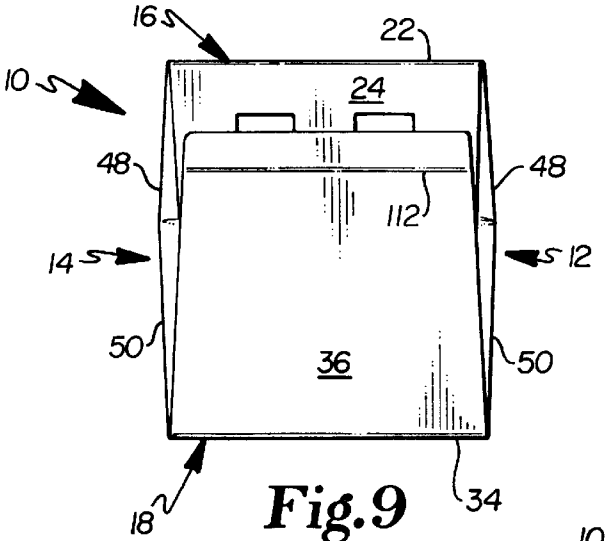
FIG. 9 is an end view along line 9—9 of the carrier of FIG. 1.
Figure 10:
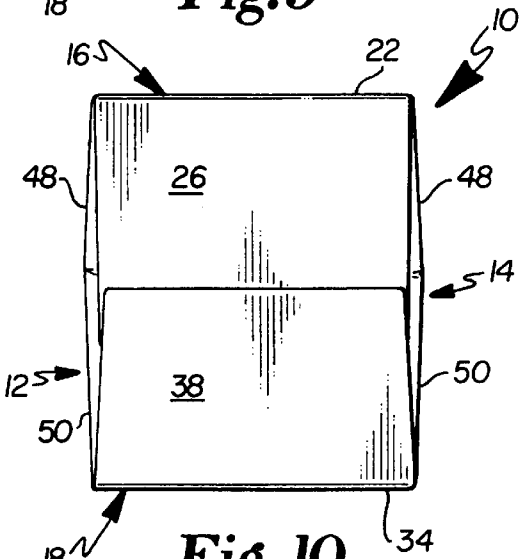
FIG. 10 is an end view along 10—10 of the carrier of FIG. 1.

A collapsed carrier or carton sleeve is formed from the blank 60 of FIG. 2 through a process shown in FIGS. 3–5. Glue is first applied to the stippled area on the handle reinforcement portion 40 as shown in FIG. 2, and the divider section 20 is folded about fold lines 94 and the handle reinforcement portion 40 is adhered to the handle grip portion 32 of the top panel section 16 as shown in FIG. 3. The divider panel 42 is then folded about fold line 86 on top of the divider panel 44 as shown in FIG. 4. Glue is applied to the stippled area on the glue flaps 90 on both of the divider panels 42 and 44 and onto the glue flap 78 that is connected to the bottom panel 34. As shown in FIG. 5, the bottom panel section 18 is folded about fold line 66 on top of the side panel section 14 so that the glue flaps 90 on the divider panels 42 and 44 are adhered to the bottom panel 34, and the side panel section 12 is folded about fold line 62 so that the lower portion 50 is adhered to the glue flap 78. The result is a flattened tube or collapsed carrier of FIG. 5.

Figure 7:
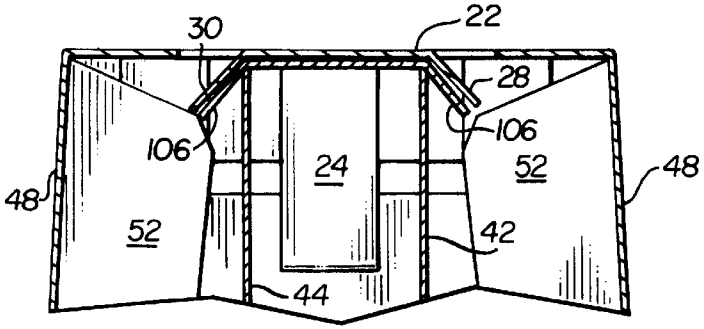
FIG. 7 is a partial cross-sectional view along line 7—7 of FIG. 1.
Figure 8:
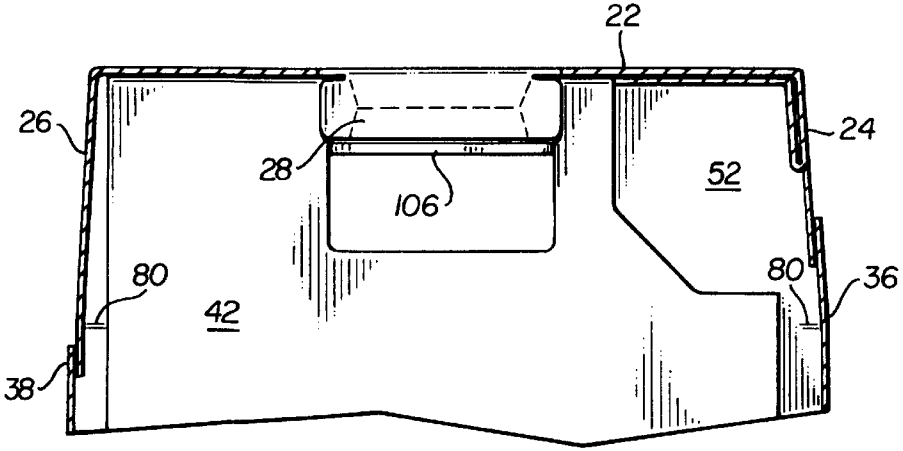
FIG. 8 is a partial cross-sectional view along line 8—8 of FIG. 1.

Typically, collapsed carriers are shipped to a packaging facility where they are erected and loaded with the articles, such as glass bottles. The ends 24, 26, 36, 38, 52 and 54 are closed by means well known in the industry to form the finished carrier of FIG. 1. The upper flaps 52 and lower flaps 54 are folded first, then the upper end panel flaps 24 and 26, and then the lower end panel flaps 36 and 38 are folded and adhered to the upper end panels 24 and 26. The lower end panel 36 may have a stress relieving score line 112 that corresponds to the edge of the upper end panel 24. The interior of the carrier 10 is illustrated in the open end view of FIG. 6 and the cross-sectional views of FIGS. 7 and 8.

Figures 11, 19:
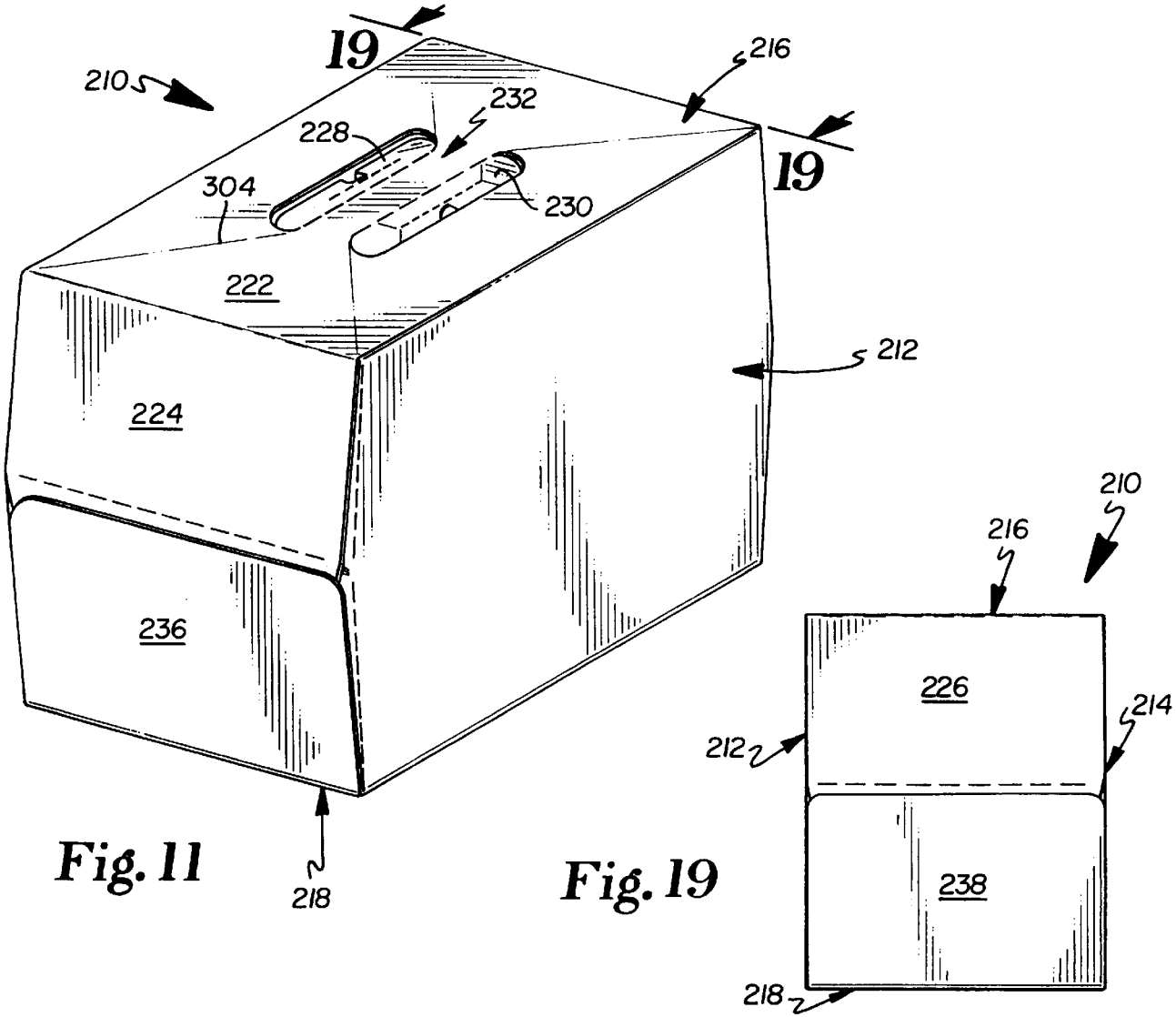
FIG. 11 is a perspective view of another embodiment of the carrier of the present invention.
FIG. 19 is an end view along line 19—19 of the carrier of FIG. 11.
Figure 16:
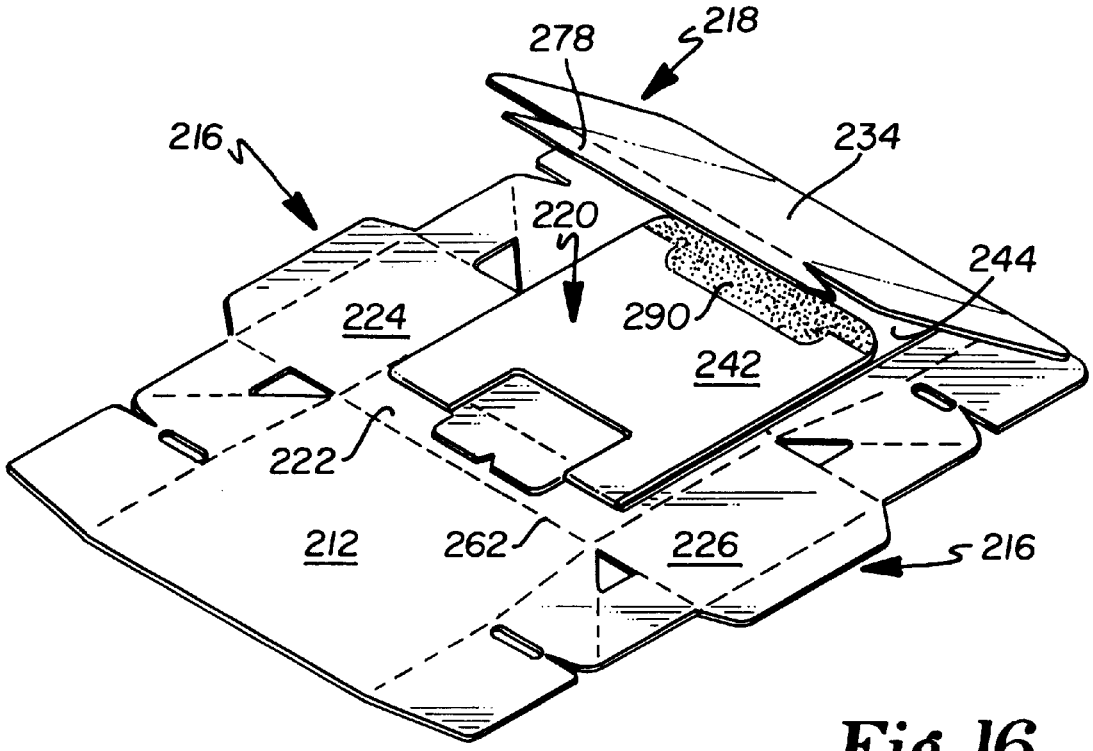
FIG. 16 is a perspective view of the blanks of FIG. 14 during a second folding and gluing step.
Figure 17:
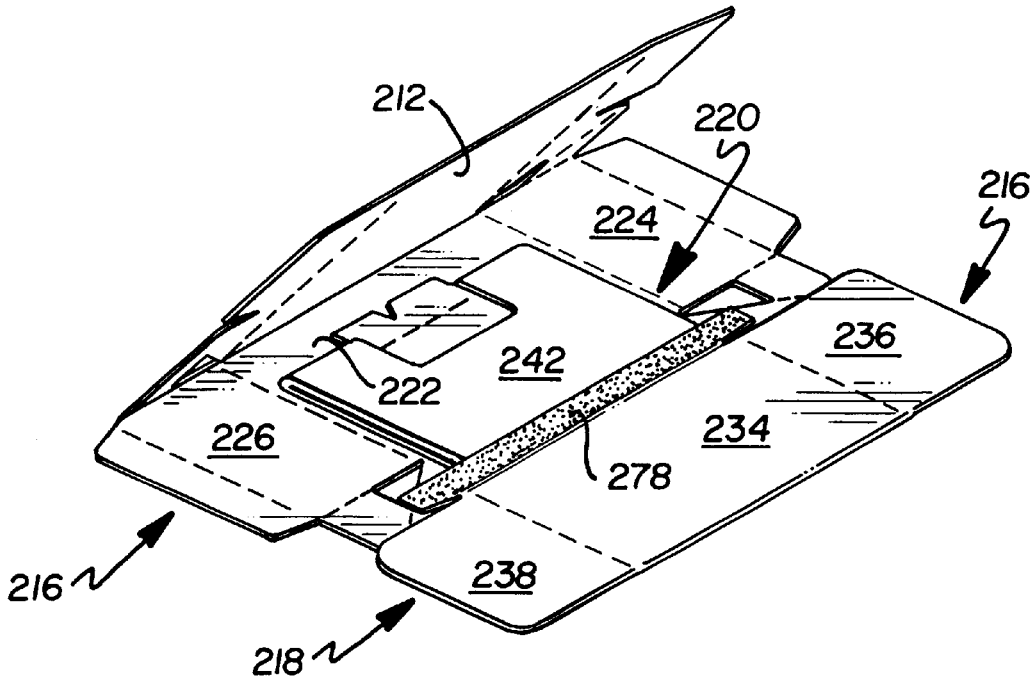
FIG. 17 is a perspective view of the blanks of FIG. 14, during a third folding and gluing step.
Figure 18:
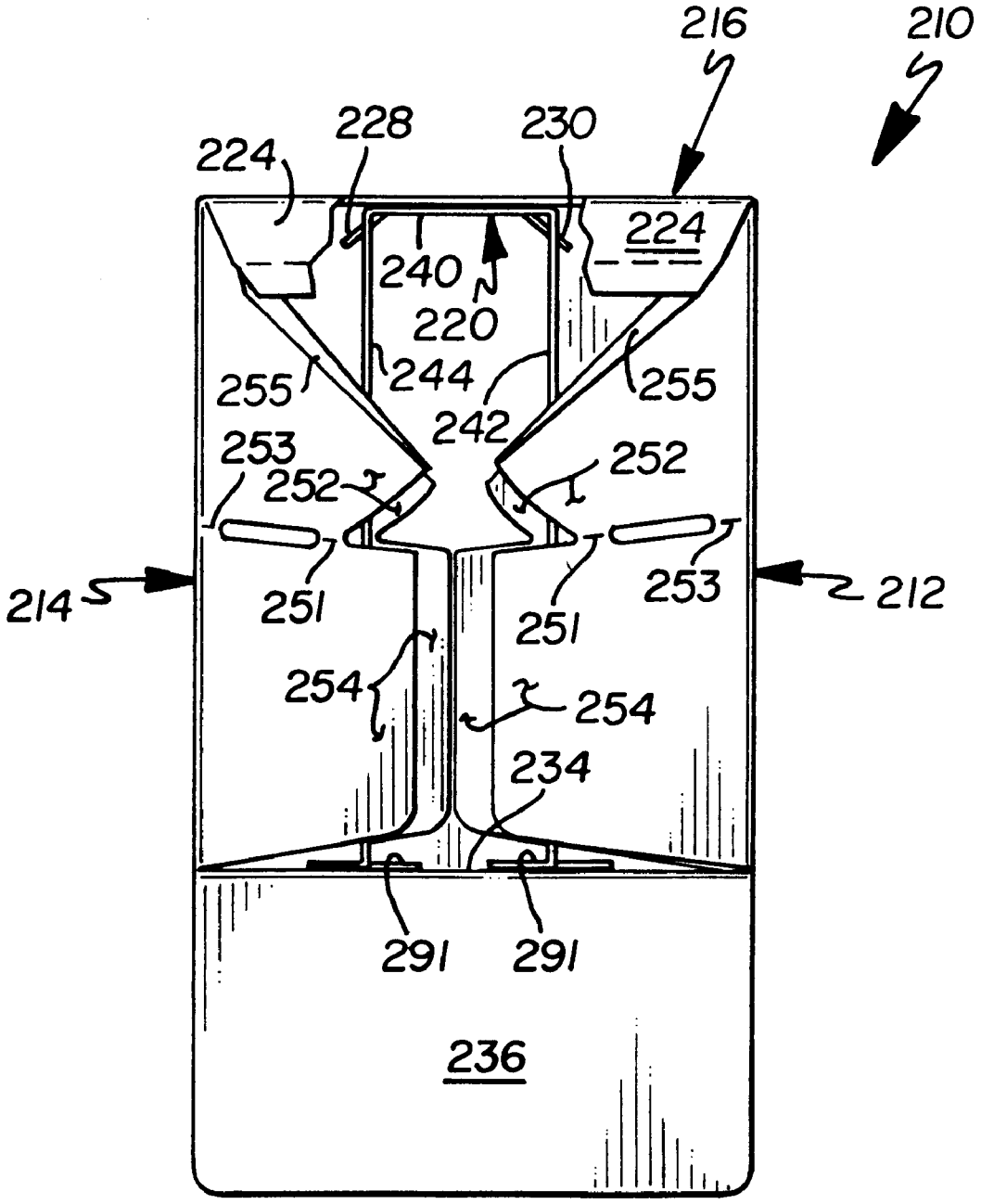
FIG. 18 is an end view, partially cut away, through an open end of the carrier of FIG. 11.

FIGS. 11–19 illustrate another embodiment of the carrier. Referring to FIGS. 11 and 18–19, the carrier 210 is generally comprised of side panel sections 212 and 214 connected to a top panel section 216 and a bottom panel section 218, and is further comprised of a divider section 220 positioned within the formed carrier 210. The top panel section 216 includes a top panel 222 and two upper end panels 224 and 226. The top panel 222 has two handle grip tabs 228 and 230 and a handle grip portion 232 positioned between the tabs 228 and 230. The tabs 228 and 230 fold inward along the edges of the handle grip portion 232 to create finger openings. The bottom panel section 218 includes a bottom panel 234 and two lower end panels 236 and 238. The upper end panels 224 and 226 and the lower end panels 236 and 238 form end panel sections for the carrier 210. The divider section 220 includes a handle reinforcement portion 240 and two divider panels 242 and 244. The handle reinforcement portion 240 is glued or otherwise attached beneath the handle grip portion 232 of the top panel 222 to form a two-ply handle. The divider panels 242 and 244 extend from the top panel 222 and are glued or otherwise attached to the bottom panel 234 to form article lanes.

Figure 13:
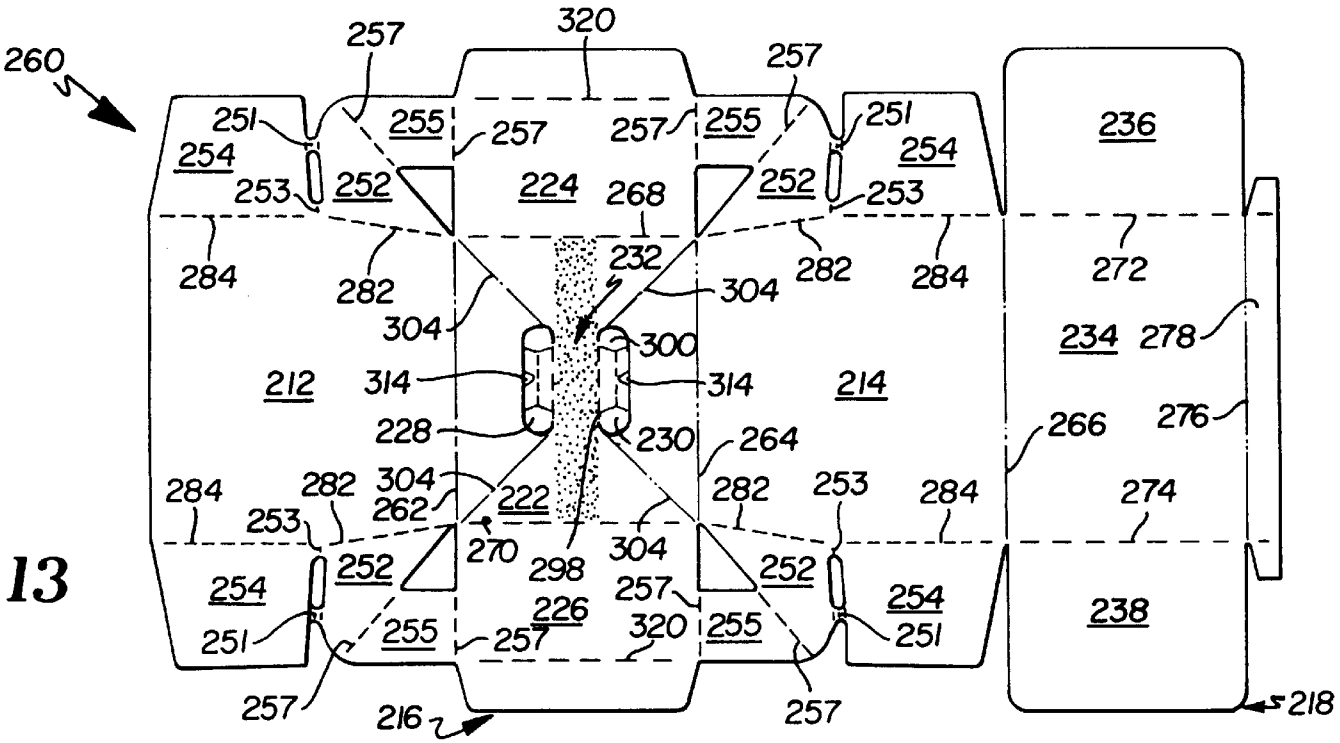
FIG. 13 is a plan view of a carrier blank used to form the carrier of FIG. 11.

Referring to FIG. 13, a generally rectangular blank 260 from which the carrier 210 is formed is comprised of the top panel section 216 connected by opposite fold lines 262 and 264 to the side panel sections 212 and 214. The bottom panel section 218 is connected by fold line 266 to the side panel section 214. The top panel section 216 includes the top panel 222 connected by fold line 268 to the upper end panel 224 and by fold line 270 to upper end panel 226. The bottom panel section 218 includes the bottom panel 234 connected by fold line 272 to the lower end panel 236, by fold line 274 to the lower end panel 238, and by fold line 276 to a glue flap 278. Each of the side panel sections 212 and 214 are connected by fold lines 282 to the upper flaps 252, and by fold lines 284 to the lower flaps 254. Fold lines 282 slightly converge toward each other to enable the top of a formed carrier to conform to the shape of bottles. The upper flaps 252 are connected to the lower flaps 254 by hinges 251 and fold lines 253. A web panel 255 is connected to the upper flaps 252 by fold lines 257.

The top panel 222 has two handle grip tabs 228 and 230 and a handle grip portion 232 positioned between the tabs 228 and 230. The tabs 228 and 230 are generally oval-shaped and are formed by a fold line 298 and a cut 300. The tabs 228 and 230 have stress relieving score lines configured to allow tabs to be pressed between two adjacent article tops in a formed carrier. The score lines preferably are configured to include a line parallel to the fold line 298 and two arcuate lines on each end of the tabs 228 and 230. The top panel 222 preferably has stress relieving score lines 304 extending from the fold lines 298 to each corner of the top panel 222 as shown in FIG. 13.

Figure 12:
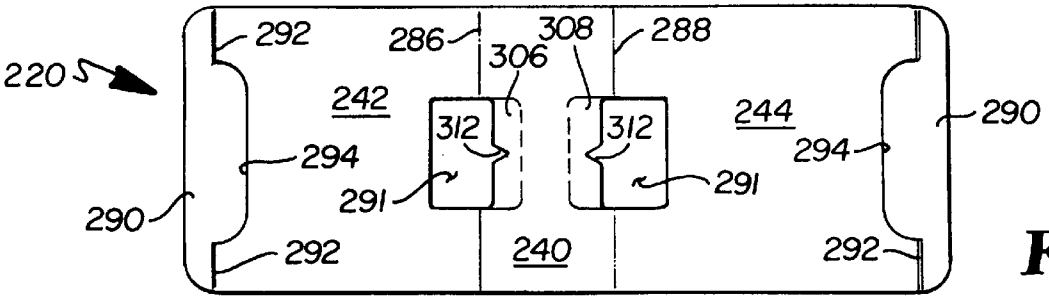
FIG. 12 is a plan view of a divider section blank used to form the carrier of FIG. 11.

The divider section blank 220, shown in FIG. 12, includes the handle reinforcement portion 240 connected by fold lines 286 to the divider panel 242 and by fold lines 288 to the divider panel 244. Each of the divider panels 242 and 244 has finger openings 291 through which a person's fingers may extend when the carrier is lifted by the handle. A glue flap 290 is connected by fold line 292 to the bottom of each of the divider panels 242 and 244. Each of the divider panels 242 and 244 has an arcuate cut 294 that provides the glue flaps 290 with a larger area to adhere to the bottom panel 234 and that enable the divider section 220 to distribute lifting forces to the bottom panel 234. Reinforcement tabs 306 and 308 are connected by fold lines 286 and 288 to the handle reinforcement handle 240. The reinforcement tabs 306 and 308 correspond to the handle grip tabs 228 and 230 in a an assembled carrier 210. The reinforcement tabs 306 and 308 have guide notches 312 that correspond to and are aligned with the guide holes 314 in the carrier blank 260 in a formed carrier 210.

Figure 14:
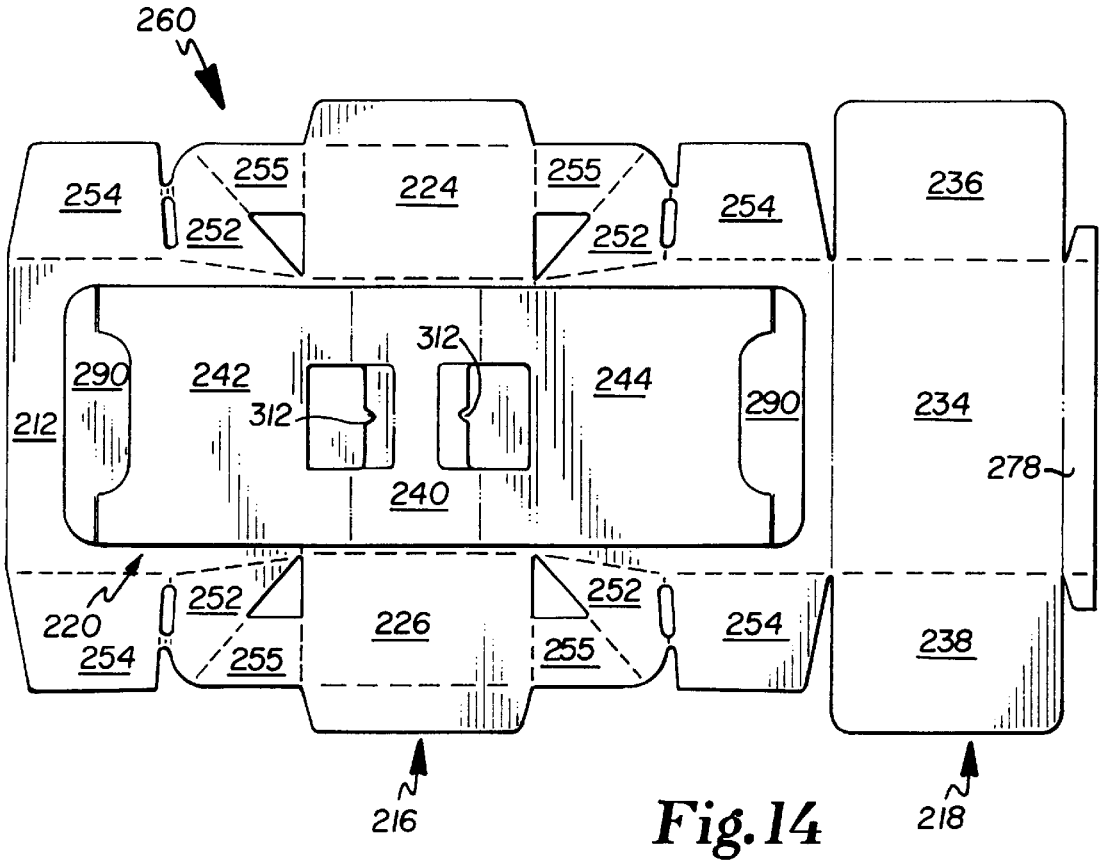
FIG. 14 is a plan view of the blanks of FIGS. 12–13 after a positioning step and a first gluing step.
Figure 15:
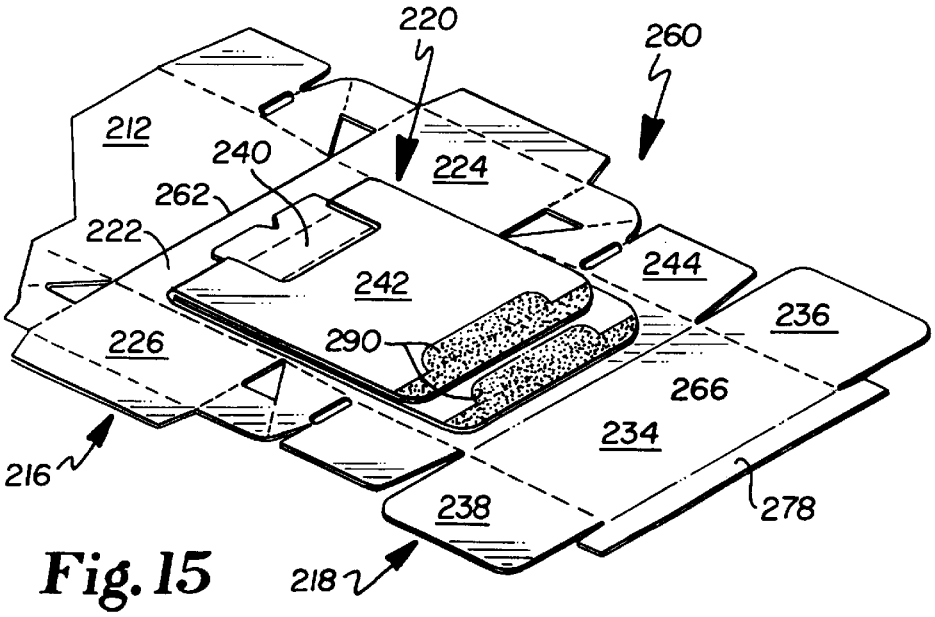
FIG. 15 is a perspective view of the blanks of FIG. 14 after a first folding step.

A collapsed carrier or carton sleeve is formed from the blanks 220 and 260 of FIGS. 12 and 13 through a process shown in FIGS. 14–17. Glue is first applied to the stippled area on the handle grip portion 232 as shown in FIG. 13, and the handle reinforcement portion 240 of the divider section 220 is adhered to the handle grip portion 222 as shown in FIG. 14. The divider section blank 220 is aligned with the carrier blank 260 by aligning the guide notches 312 with the guide holes 314. The divider panel 242 is then folded about fold line 286 on top of the divider panel 244 as shown in FIG. 15. Glue is applied to the stippled area on the glue flaps 290 on both of the divider panels 242 and 244. As shown in FIG. 16, the bottom panel section 218 is folded about fold line 266 on top of the side panel section 214 so that the glue flaps 290 on the divider panels 242 and 244 are adhered to the bottom panel 234. As shown in FIG. 17, the side panel section 212 is folded about fold line 262 so that the lower edge of side panel section 212 is adhered to the glue flap 278. The result is a flattened tube or collapsed carrier.

Typically, collapsed carriers are shipped to a packaging facility where they are erected and loaded with articles, such as glass bottles. The ends 224, 226, 236, 238, 252 and 254 are closed by means well known in the industry to form the finished carrier of FIG. 11. The upper flaps 252 and lower flaps 254 are folded first. Folding the upper flaps 252 causes the web panels 255 to pull down the upper end panel flaps 224 and 226. The lower end panel flaps 236 and 238 are folded and adhered to the upper end panels 224 and 226. The upper end panels 224 and 226 may have a stress relieving score line 320 that corresponds to the edge of the lower end panels 236 and 238. The interior of the carrier 210 is illustrated in the partially open end view of FIG. 18 and is seen to have similarities to the view shown in FIG. 6.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A flat blank for forming a bottle carrier, comprising:

(a) a top panel section having opposing side edges, said top panel section including a top panel, a first upper end panel, and a second upper end panel, said top panel having opposing end edges, each of said upper end panels having a top edge, said top edge of each of said upper end panels being connected to one of said end edges of said top panel, said top panel having two handle grip tabs and a handle grip portion positioned between said handle grip tabs, each of said handle grip tabs being formed by a fold line and a cut, said handle grip tabs being connected to said handle grip portion of said top panel by said fold line;

(b) a first side panel section and an opposing second side panel section, each of said side panel sections having a top edge and an opposing bottom edge, said top edge of each of said side panel sections being connected to one of said side edges of said top panel section;

(c) a bottom panel section, said bottom panel section comprising a bottom panel, a first lower end panel, and a second lower end panel, said bottom panel having opposing side edges and opposing end edges, said bottom edge of said first side panel section being connected to one of said side edges of said bottom panel, a glue flap being connected to the other one of said side edges of said bottom panel, each of said lower end panels having a bottom edge, said bottom edge of each of said lower panels being connected to one of said end edges of said bottom panel; and (d) a divider section, said divider section including a handle reinforcement portion, a first divider panel, a second divider panel, and at least one hinge flap, said handle reinforcement portion having parallel side edges, each of said divider panels having a top edge foldably connected to one of said side edges of said handle reinforcement portion, each of said divider panels further having a bottom edge and a glue flap, said glue flap being foldably connected to said bottom edge of said divider panel, said divider section being connected to said top panel section, said at least one hinge flap being foldably connected to said handle reinforcement portion and to said second top end panel.

2. A carrier, comprising:

(a) a top panel section having opposing side edges;

(b) a first side panel section and an opposing second side panel section, each of said side panel sections having a top edge and an opposing bottom edge, said top edge of each of said side panel sections being foldably connected to one of said side edges of said top panel section;

(c) a bottom panel section having opposing side edges, said bottom edge of each of said side panel sections being connected to one of said side edges of said bottom panel section; and (d) a divider section having at least one divider panel extending between said top panel section and said bottom panel section, said divider section being attached to said top panel section and to said bottom panel section, wherein said divider section comprises a handle reinforcement portion, a first divider panel, and a second divider panel, said handle reinforcement portion having opposing side edges, each of said divider panels having a top edge foldably connected to one of said side edges of said handle reinforcement portion, said handle reinforcement portion being connected to said top panel section.

3. The carrier of claim 2, wherein said top panel section comprises a top panel, a first upper end panel, and a second upper end panel, said top panel having opposing end edges, each of said upper end panels having a top edge, said top edge of each of said upper end panels being connected to one of said end edges of said top panel.

4. The carrier of claim 3, wherein said top panel has two handle grip tabs and a handle grip portion positioned between said handle grip tabs, each of said handle grip tabs being formed by a fold line and a cut, said fold line connecting said handle grip tab to said handle grip portion of said top panel.

5. The carrier of claim 4, wherein each of said handle grip tabs has score lines, said score lines being configured for said tabs to be pressed between two adjacent article tops.

6. The carrier of claim 4, wherein said top panel has stress relieving score lines extending from each of said fold lines defining said handle grip tabs to a corner of said top panel.

7. The carrier of claim 2, wherein each of said side panel sections comprises an upper portion connected to a lower portion by a fold line, each of said upper portions being connected to one of said side edges of said top panel by a fold line, said lower portion of said first side panel section being connected to said bottom panel section by a fold line.

8. The carrier of claim 7, wherein each of said lower portions and each of said upper portions have opposing end edges, each of said side panels further including a pair of upper flaps and a pair of lower flaps, said upper flaps being connected to said end edges of said upper portion, said lower flaps being connected to said end edges of said lower portion.

9. The carrier of claim 2, wherein said bottom panel section comprises a bottom panel, a first lower end panel, and a second lower end panel, said bottom panel having opposing end edges, each of said lower end panels having a bottom edge, said bottom edge of each of said lower end panels being connected to one of said end edges of said bottom panel.

10. The carrier of claim 2, wherein a glue flap is connected to one of said side edges of said bottom panel section by a fold line, said glue flap being connected to said second side panel section.

11. The carrier of claim 2, wherein each of said divider panels has a bottom edge and a glue flap foldably connected to said bottom edge, each of said glue flaps being connected to said bottom panel section.

12. The carrier of claim 2, wherein said first dividing panel and said second dividing panel are parallel.

13. An article carrier, comprising:

(a) a top panel section having opposing side edges;

(b) a first side panel section and an opposing second side panel section, each of said side panel sections having a top edge and an opposing bottom edge, said top edge of each of said side panel sections being foldably connected to one of said side edges of said top panel section;

(c) a bottom panel section having opposing side edges, said bottom edge of each of said side panel sections being connected to one of said side edges of said bottom panel section; and (d) a divider section, said divider section being attached to said top panel section and to said bottom panel section, said divider section including a handle reinforcement portion, a first divider panel and a parallel second divider panel, said divider panels extending between said top panel section and said bottom panel section, said handle reinforcement portion having opposing side edges, each of said divider panels having a top edge foldably connected to one of said side edges of said handle reinforcement portion, said handle reinforcement portion being attached to said top panel section, each of said divider panels having a bottom edge and a glue flap foldably connected to said bottom edge, each of said glue flaps being attached to said bottom panel section.

14. A bottle carrier, comprising:

(a) a top panel section having opposing side edges, said top panel section including a top panel, a first upper end panel, and a second upper end panel, said top panel having opposing end edges, each of said upper end panels having a top edge, said top edge of each of said upper end panels being connected to one of said end edges of said top panel, said top panel having two handle grip tabs and a handle grip portion positioned between said handle grip tabs, each of said handle grip tabs being formed by a fold line and a cut, said fold line connecting said handle grip tab to said handle grip portion of said top panel;

(b) a first side panel section and an opposing second side panel section, each of said side panel sections having a top edge and an opposing bottom edge, said top edge of each of said side panel sections being foldably connected to one of said side edges of said top panel section;

(c) a bottom panel section having opposing side edges, said bottom edge of each of said side panel sections being connected to one of said side edges of said bottom panel section, said bottom panel section including a bottom panel, a first lower end panel, a second lower end panel, and a glue flap, said bottom panel having opposing end edges, each of said lower end panels having a bottom edge, said bottom edge of each of said lower end panels being connected to one of said end edges of said bottom panel, said glue flap being connected to one of said side edges of said bottom panel section by a fold line, said glue flap being connected to said second side panel section; and (d) a divider section, said divider section being attached to said top panel section and to said bottom panel section, said divider section including a handle reinforcement portion, a first divider panel and a parallel second divider panel, said divider panels extending between said top panel section and said bottom panel section, said handle reinforcement portion having opposing side edges, each of said divider panels having a top edge foldably connected to one of said side edges of said handle reinforcement portion, said handle reinforcement portion being attached to said top panel section, each of said divider panels having a bottom edge and a glue flap foldably connected to said bottom edge, each of said glue flaps being attached to said bottom panel section.

* * * * *